United States Patent [19]

Bishop et al.

[11] 4,076,104

[45] Feb. 28, 1978

[54] SAFETY LATCH FOR AUTOMOTIVE HOISTS

[75] Inventors: Burton DeWolfe Bishop; Lawrence E. Murray, both of Salisbury, Md.

[73] Assignee: Dresser Industries, Inc., Dallas, Tex.

[21] Appl. No.: 769,972

[22] Filed: Feb. 18, 1977

[51] Int. Cl.[2] ..... B66F 7/28

[52] U.S. Cl. ..... 187/8.5

[58] Field of Search ..... 187/8.41, 8.47, 8.49, 187/8.5

[56] References Cited

U.S. PATENT DOCUMENTS

| | | | |
|---|---|---|---|
| 2,059,059 | 10/1936 | Thompson | 187/8.5 |
| 2,201,189 | 5/1940 | Makaroff et al. | 187/8.49 |
| 2,750,004 | 6/1956 | Harrison | 187/8.5 |
| 2,849,084 | 8/1958 | Hott et al. | 187/8.5 |
| 2,954,100 | 9/1960 | Harr | 187/8.49 |
| 3,934,680 | 1/1976 | Bishop | 187/8.5 |

FOREIGN PATENT DOCUMENTS

| | | | |
|---|---|---|---|
| 1,312,475 | 11/1962 | France | 187/8.47 |

*Primary Examiner*—Robert W. Saifer

*Assistant Examiner*—James L. Rowland

*Attorney, Agent, or Firm*—Daniel Rubin

[57] ABSTRACT

A safety latch preventing inadvertent lowering or dropping of an automotive hoist by means of a torsionally biased pawl shaft that automatically self engages with a lateral notch located in the lift at hoist operating height. The backside of a vertically movable gear rack attached to the hoist includes the pawl notch near its lower end and which when raised cooperates with the pawl shaft for effecting a latching relation therewith. The pawl shaft is slotted to embrace the gear rack and is manually releasable for permitting hoist descent by a partial rotation which in one embodiment is effected by manually shifting a bi-stable locking rod. Reset for latching on subsequent ascent of the gear rack is effected by descending engagement of the hoist bolster against the bi-stable locking rod. In an alternative embodiment release is obtained by raising a lift pin which similarly effects partial rotation of the biased pawl shaft. An auxiliary latch in the alternative embodiment prevents self-reset of the pawl shaft until after the notch descends a distance beyond which the pawl shaft and notch could otherwise relatch.

12 Claims, 13 Drawing Figures

FIG. 1
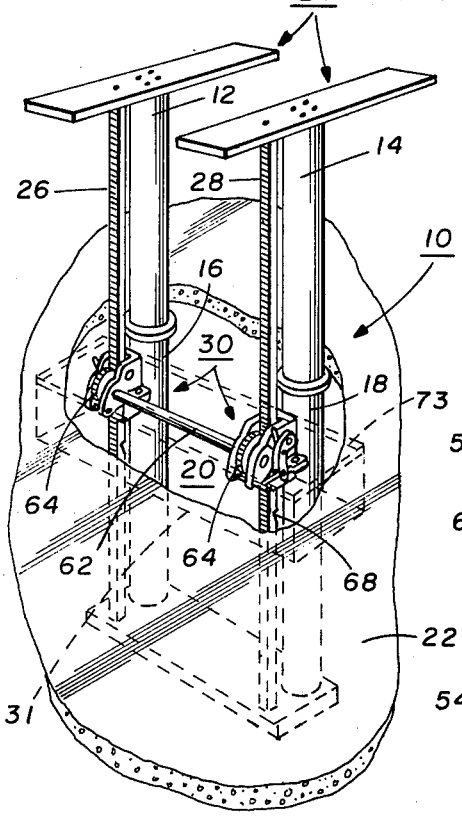
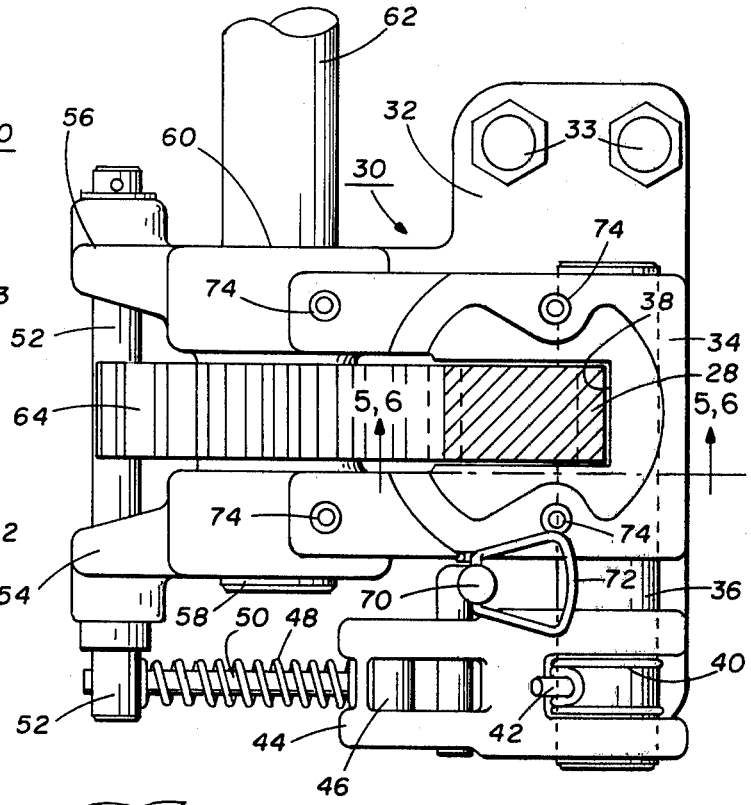
FIG. 4
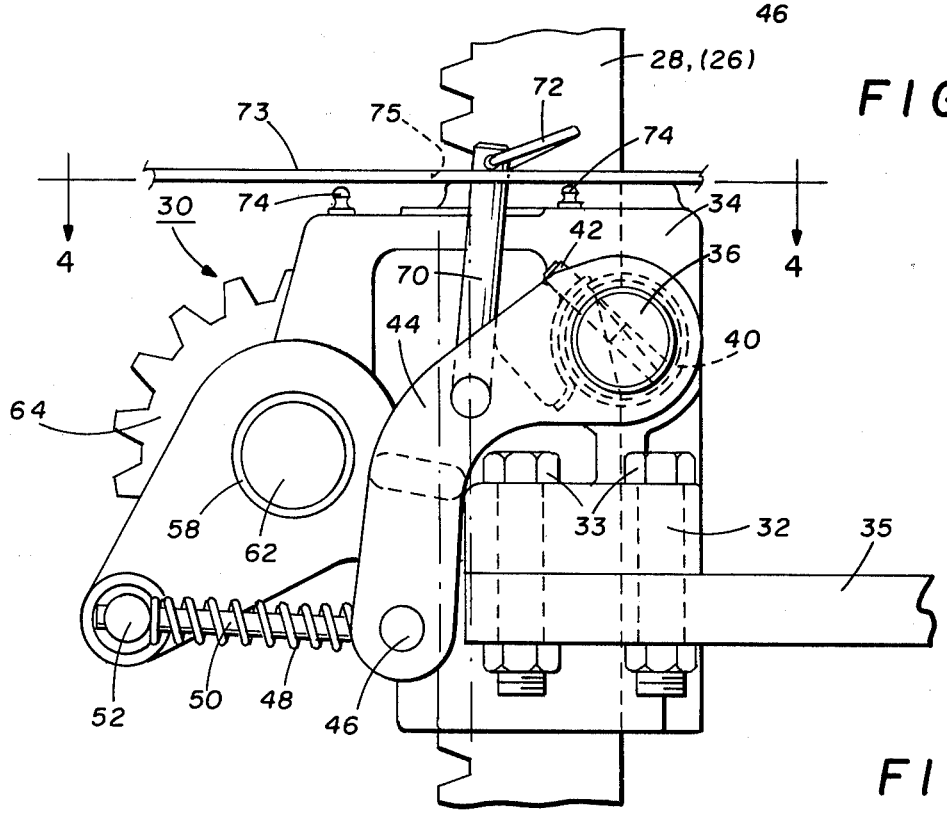
FIG. 2

SAFETY LATCH FOR AUTOMOTIVE HOISTS

BACKGROUND OF THE INVENTION

1. The field of art to which the invention pertains includes the art of hoists and lifts for roadway vehicles.

2. Automotive-type hoists are widely used at gasoline stations, repair garages and the like wherever automotive service is customarily performed on the underside of a roadway vehicle. Such hoists are commercially available from a variety of manufacturers and while the hoists may differ in detail from one manufacturer to another, they generally consist of a superstructure including a bolster or a pair of bolsters to which lifting means such as arms or wheel tracks are attached enabling underlying support of a vehicle. A lift mechanism usually driven either electrically or hydraulically operates to elevate a supported vehicle to proper operating height. Since service personnel freely move about beneath an elevated automobile, it is common and indeed made necessary by many local codes to require a fail safe safety device of sorts to prevent lowering or dropping of the hoist other than when expressly intended. Various latch mechanisms for this purpose are known as disclosed, for example, in U.S. Pat. Nos. 2,059,059; 2,750,004; 2,857,985; 3,706,356; and 3,934,680.

While the mechanisms disclosed by these patents undoubtedly would or have functioned well for the purposes intended, they can by generally characterized as of undue complexity and relatively high cost of manufacture and/or installation. Despite recognition of the foregoing, a more satisfactory solution has not heretofore been known.

SUMMARY OF THE INVENTION

This invention relates to automotive hoists and more specifically to a novel safety latch mechanism therefor automatically self-operative to prevent inadvertent dropping or lowering of such hoists from their elevated position. In accordance herewith, this is achieved by use of a torsionally biased pawl shaft secured at a stationary height relative to a gear rack secured to the hoist superstructure for elevated movement therewith. The pawl shaft is slotted to embrace the gear rack which at a near-bottom location correlated to the elevated operating position of the hoist includes a lateral notch that cooperates with the oppositely positioned pawl to effect a latching engagement. As the gear rack is raised in conjunction with the hoist, the rack notch reaches a substantially coincident elevation as that of the pawl shaft. With the pawl shaft being constantly biased torsionally toward the rack, it rotatably penetrates the notch to effect the latching engagement.

Release to permit intended lowering of the hoist requires manual disengagement of the pawl shaft from the notch and is effected by a partial reverse rotation of the pawl shaft from its latching relation. In one embodiment, release is achieved by manually shifting a bi-stable locking rod from a forward position at which the torsionally biased pawl shaft is latched in the vertical path of the rack notch. Withdrawing the bi-stable mechanism uncocks the latched relation by a partial rotation of the pawl shaft away from the rack until clear thereof. When the bi-stable mechanism is in its withdrawn position, it extends into the path of the lowering bolsters and on eventual engagement between the bolster and bi-stable mechanism the safety latch is recocked to its forward position for the next ascent cycle. In an alternative embodiment, release of the safety latch is effected for a short descent distance of the hoist via a lift pin similarly rotating the pawl shaft away from the rack notch. An auxiliary latch is simultaneously actuated to maintain the pawl shaft disengaged until at least sufficient hoist lowering has occurred to preclude relatching by the pawl.

Since the mechanisms in either embodiment are relatively simple as compared to the similar purpose constructions of the prior art, their lower cost and simplicity of installation and/or maintenance afford distinct advantages over similar purpose units previously available.

It is therefore an object of the invention to provide a novel safety latch mechanism for an automotive hoist.

It is a further object of the invention to provide a novel safety latch for an automotive hoist that is simple in construction and yet reliable in operation as to overcome the deficiencies of similar purpose safety latch mechanisms of the prior art.

It is a still further object of the invention to effect the foregoing objects with a latching mechanism able to be easily added as a retrofit onto existing hoist equipment.

BRIEF DESCRIPTION OF THE DRAWINGS

FIG. 1 is an isometric view of an automotive hoist mechanism utilizing the safety latch mechanism hereof;

FIG. 2 is a side view of a first embodiment safety latch mechanism hereof shown in its latched relation;

FIG. 4 is a plan view partially in section as seen substantially along the lines 4—4 of FIG. 2;

Figure 3:
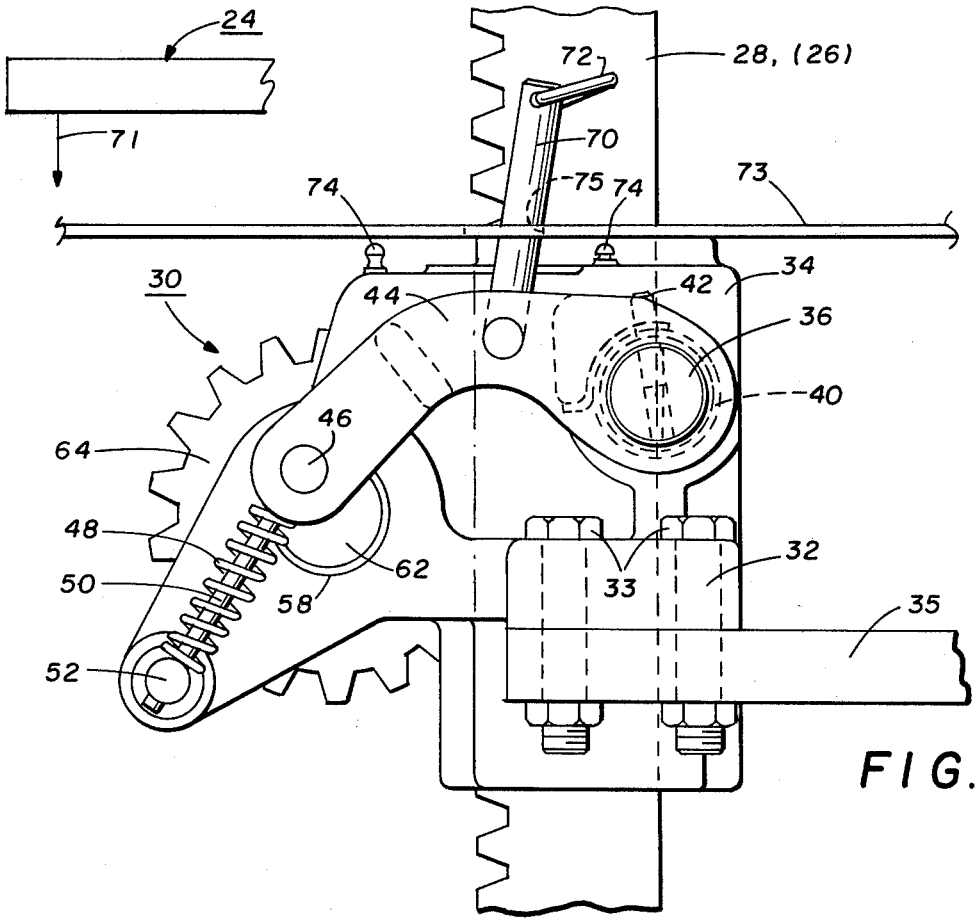
FIG. 3 is a side view of the safety latch mechanism of FIG. 2 in its released relation.

Referring initially to FIG. 1, there is illustrated an automotive hoist 10 of the two post type including identical pistons 12 and 14 which at their free ends support a superstructure in the form of bolsters 24. The pistons are telescopically arranged with respect to cylinders 16 and 18 that extend downward into an excavation 20 below a normally concrete work floor 22. Secured to the bolsters parallel to the pistons for stabilizing vertical movement thereof are a pair of gear racks 26 and 28. A hydraulic system (not shown) operates the hoist for elevating and lowering an automobile in a well known manner.

Once raised, the hoist is prevented against inadvertent lowering by means of a latching mechanism 30 which will first be described in accordance with the preferred embodiment of FIGS. 2–6. As there shown, each latch mechanism 30 hereof is situated in a trench 31 and includes a housing 32 adapted for secured mounting via bolts 33 to a fixed support 35. Contained in the housing is a bearing 34 supporting a pawl shaft 36 for rotation therein. The pawl shaft is transversely slotted or recessed in a U-shape at 38 to more or less contiguously straddle the backside of rack 28 for permitting a relative sliding relationship between them. Torsionally biasing pawl shaft 36 in a counterclockwise direction, as viewed in FIG. 2, is a wound torsion spring 40. Spring 40 terminates secured at one end about an elongaged transverse pin 42 extending outward of the pawl shaft for engagement with the upper end of a bifurcated lever arm 44. The spring biases pin 42 against lever 44 which serves to limit counterclockwise rotation of the pawl shaft. The lower or trailing portion of lever arm 44 contains a transverse rod 46 being urged rightward in the direction illustrated by means of a compressed coil spring 48 wound about a dowel 50. Dowel 50, in turn, is transversely secured between rod 46 and rod 52, the latter of which is supported for rotation through the bifurcated open ends 54 and 56 of housing 32. Likewise contained in housing ends 54 and 56 are journals 58 and 60, respectively, in which to support one end of a rotatable pinion shaft 62 connecting the opposite latch mechanisms 30 at each post and supporting a pinion 64 in meshing engagement with each of racks 26 and 28. Contained at a predetermined location on the backside of each rack is a notch 68 for reasons as will be explained. Gear racks 26 and 28, pinions 64 and connecting shaft 62 provide a stabilizing mechanism causing pistons 12 and 14 of the hoist to rise and lower in unison.

Figure 5:
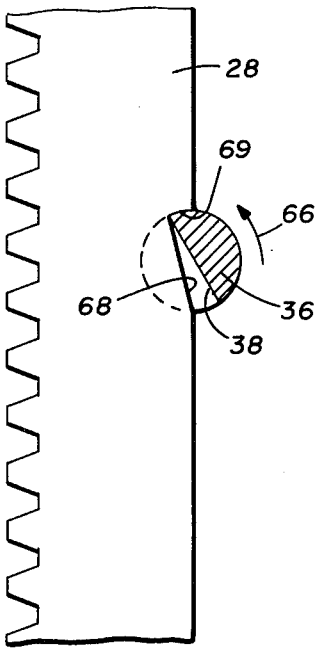
FIGS. 5 and 6 are fragmentary sectional elevations seen substantially along the lines 5,6 — 5,6 of FIG. 4 for the latched and unlatched relations, respectively.
Figure 6:
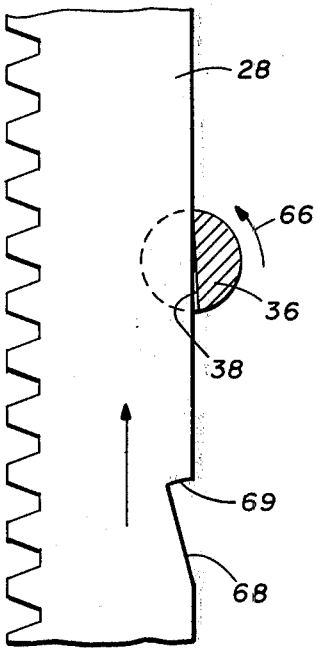

During the course of hoist ascent, the latch mechanism components are generally maintained in the cocked relationships illustrated in FIGS. 2, 4 and 6 with shaft 36 torsionally biased counterclockwise as shown by arrow 66 in FIG. 6. By reason of the bias force the upper edge of slot 38 is placed in a more or less dragging engagement against the backside surface of the ascending gear rack. As the hoist and gear rack continue to be elevated, notch 68 ultimately reaches an elevated position coinciding with the rotational path of pawl shaft 36 permitting a downside interlock to occur as shown in FIG. 5 between pawl shaft 36 and notch shoulder 69. For these purposes, therefore, one or more notches 68, each correlated to an operative hoist elevation to be maintained, are upwardly tapered in an inward direction to accept pawl shaft 36. In this manner, leading edge engagement of the pawl shaft against the underside of shoulder 69 prevents any downward movement of the hoist. Any desired number of displaced notches can be employed as would correlate with the elevated positions at which the hoist is intended to be utilized.

To effect release from the latched relation of FIG. 5 for the purpose of lowering the hoist, there is provided an L-shaped cocking rod 70, the lower end of which is pivotally supported in lever 44 and the upper free end of which includes a lift ring 72 accessible above cover plate 73 covering trench 31. Manually pulling on the lift ring revolves lever 44 about shaft 36 changing the relative relationship of latch components from the position of FIG. 2 to that of FIG. 3. During the course of this change, pin 42 and consequently pawl shaft 36 are rotated clockwise (FIG. 2) through an angular extent of about 45° in opposition to the torsional force of spring 40. In so doing, slot 38 of the pawl shaft is outwardly displaced from shoulder notch 69 to a position more nearly corresponding to that of FIG. 6 thereby enabling the hoist to descend toward ground level. A slotted aperture 75 in cover plate 73 serves to maintain rod 70 in a vertical position such that when the entire superstructure approaches ground level (arrow 71) it touches the top of rod 70 pushing it downward and causing it to snap over center for restoring the cocked relation of FIG. 2. It can be appreciated that the foregoing arrangement of components form a bi-stable mechanism readily placeable in either of two constrained positions, the upper stop of which is provided by cover plate 73 while the lower stop is provided by support 35. Grease fittings 74 are provided for lubricating the various mechanism to be maintained.

Reference is now made to FIGS. 7–13 by which the second embodiment in accordance herewith will be described. The latching mechanism here is designated 30′ and as above includes a housing 76 supporting a rotatable pawl shaft 78. The pawl shaft is centrally slotted at 80 in order to contiguously straddle racks 26 and 28. As before, each rack includes at least one upwardly tapered notch 82 having a shoulder 83 that when elevated opposite pawl shaft 78 correlates to the elevated position at which the hoist is to be operative. Housing 76 similarly supports a pinion shaft 62′ on which pinion 64′ meshes with gear racks 26 and 28.

Figure 7:
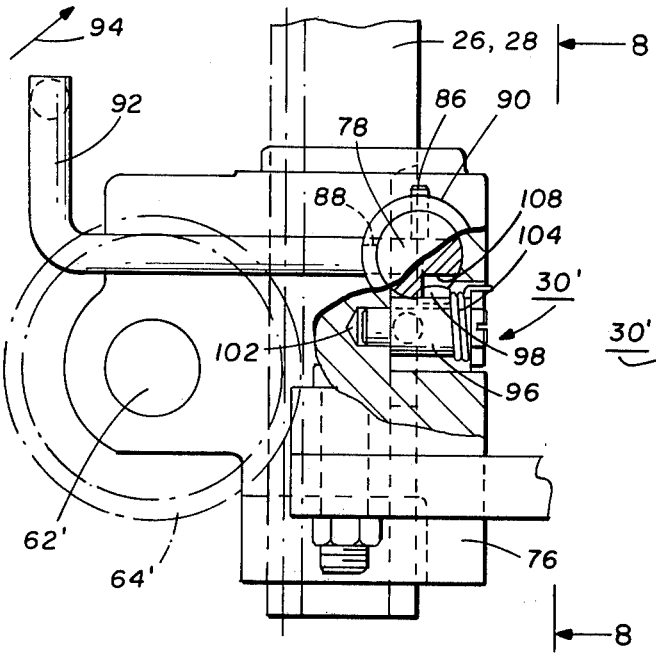
FIG. 7 is a side view partially in section of a second embodiment safety latch mechanism hereof shown in its latched relation.
Figure 8:
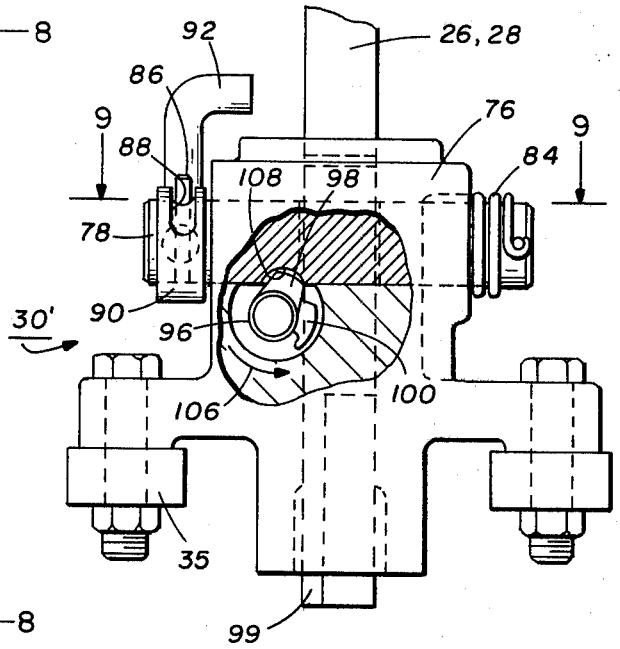
FIG. 8 is an end view as seen substantially along the lines 8—8 of FIG. 7.
Figure 9:
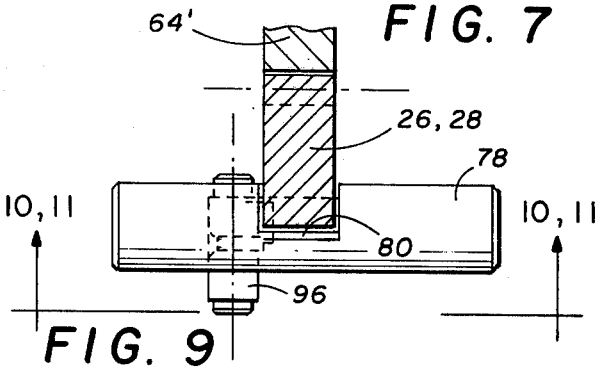
FIG. 9 is a fragmentary plan view as seen substantially along the lines 9—9 of FIG. 8.
Figure 10:
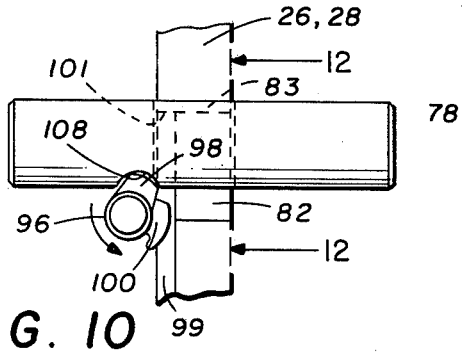
FIGS. 10 and 11 are fragmentary front elevations as seen substantially along the lines 10, 11 — 10, 11 for the release and unreleased relations of the latching mechanism.
Figure 12:
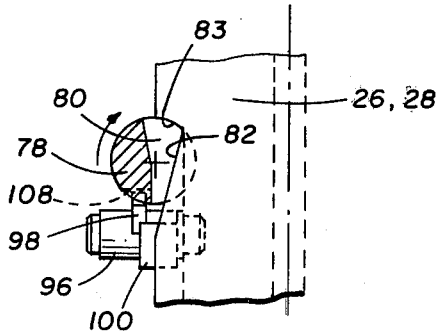
FIG. 12 is a fragmentary sectional elevation as seen along the lines 12—12 of FIG. 10.
Figure 11:
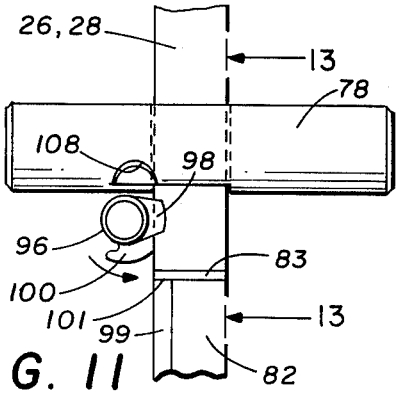
Figure 13:
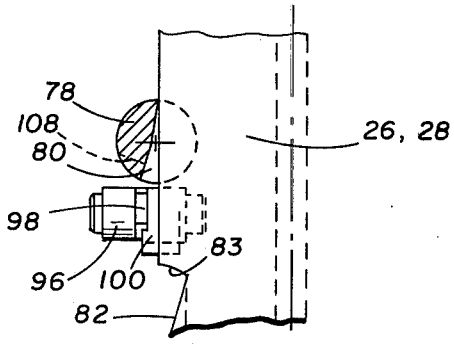
FIG. 13 is a fragmentary sectional elevation as seen along the lines 13—13 of FIG. 11.

Rotationally biasing pawl shaft 78 toward the notching relation is a wound torsion spring 84. A transverse pin 86 extending radially outwardly of the shaft through the apertured portion 88 of releasing bar sleeve 90 acts to limit rotational movement in a counterclockwise direction (FIG. 7). In this manner, pawl shaft 78 operates similarly to pawl shaft 36 above in that on notch 82 being elevated to the pawl level, the latter is free to rotate inwardly of the notch to establish a latching relation preventing downward movement of racks 26 and 28.

For unlatching the pawl shaft 78 from racks 26, 28 in accordance with this embodiment, there is provided an elongated release bar 92 radially connected to bar sleeve 90 which may be rotated on pawl shaft 78. When bar 92 is raised in the direction of arrow 94 (FIG. 7) pawl shaft 78 is rotated causing it to disengage from the notch. As before, this would ordinarily enable downward movement of the hoist to be undertaken. However, to preclude immediate relatching on release of lever 92, there is contained in housing 76 a cam 96 rotatably supported in a drilled aperture 102 arranged extending with its axis transverse to that of the pawl shaft. The cam includes spaced lobes 98 and 100 separated through an angle of approximately 60°. Formed in pawl shaft 78 to receive lobe 98 is a moon slot 108 while racks 26, 28 each include a vertical side face recess 99 extending downward from a shoulder 101 for acting against lobe 100 as will be understood. Rotationally biasing cam 96 in the counterclockwise direction of arrow 106 (FIG. 8) is a torsion spring 104 thereby urging lobe 98 inwardly of moon slot 108.

In this arrangement, the disengagement of pawl shaft 78 from notch 82 simultaneously exposes slot 108 to cam lobe 98 for the latter to lock the pawl shaft in its unlatched relation free of notch 82. As the gear racks descend with the hoist a distance safely below that at which relatching could occur, shoulder 101 of rack recess 99 engages the other cam lobe 100 forcing a clockwise rotation of cam 96 until lobe 98 is displaced outward of slot 108. This latter action permits spring 84 to restore pawl shaft 78 to its cocked but unlatched relation of FIG. 13 in preparation for the next ascent.

In operation, both safety latch embodiments employ a torsionally biased slotted pawl shaft straddling the gear rack of the respective hoist posts. The backside of each gear rack includes a notch formed in its back surface at a lower location correlated to cooperate with the pawl shaft at a predetermined elevated position of the hoist. One or more notches at different vertical elevations on the rack can be employed as desired and on reaching a coincident position the pawl shaft and notch cooperate to prevent lowering of the hoist until a manual release has been actuated.

In the preferred embodiment of FIGS. 2–6, release is effected by manually withdrawing a cocking rod 70 from the relationship of FIG. 2 to that of FIG 3. This has the effect of partially rotating pin 42 to in turn partially rotate pawl shaft 36 sufficient to disengage the pawl shaft from an interlocking fit beneath notch shoulder 69. On unlatching or uncocking being achieved, the rack is free to be moved downward. On the bolsters 24 approaching the floor position, the underside of each engages the respective cocking rod 70 in a manner forcing its restoration to the cocked relationship of FIG. 2 whereby the pawl shaft will automatically relatch the gear rack when its notch 68 is again elevated to the cooperating position.

For the embodiment of FIGS. 7–13, pawl shaft 78 is similarly operative for latching but is released by means of raising an L-shaped release bar 92 which rotates the pawl to its disengaged position with respect to latching notch 82. Simultaneously with disengagement, biased cam 96 is rotated permitting it to engage and temporarily retain the pawl in the unlatched position. After a sufficient descent of the gear rack has occurred, descending rack shoulder 101 of recess 99 rotates the cam out of pawl engagement enabling torsion spring 84 to restore the pawl shaft to its cocked relation of FIG. 13. On subsequent raising of the hoist to the position whereby notch 82 coincides with the operating position of pawl shaft 78, the latter is free to rotate inward of the former for effecting a latch engagement with the underside of notch shoulder 83.

From the above description there has been disclosed a novel safety latch construction for an automotive hoist in which a simple rotating mechanism is continually effective for automatically latching the hoist against inadvertent lowering or dropping. Since the mechanisms employed for that result are relatively simple as compared to similar purpose constructions of the prior art, it enjoys relatively low cost while affording a greater simplicity of installation and/or maintenance than was previously known for these purposes. Whereas a two post hoist has been described for purposes of illustration, it is not intended as a limitation since quite obviously the invention is useful without regard to the number of posts employed. Also, whereas the posts have been described as containing a single notch for purposes of cooperating with the latching mechanism, it is apparent that any suitable number of notches can be employed at different height locations for similar cooperation at any intermediate position at which the hoist is to be operated. For existent hoists utilizing rack and pinion stabilizing, the safety latches hereof can be readily and inexpensively retrofitted without additional excavation or mechanical surgery. Likewise, the safety latches hereof could be utilized without a gear rack construction by providing a similarly notched surface for cooperating with the pawl shaft.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. In an automotive hoist including a hoisting mechanism, the combination of an automatically operable safety latch comprising in combination:

a. a vertical member defining a lateral recess in a vertically extending surface thereof;

b. a pawl shaft extending transversely of said member and having a lateral slot defined at a location between its ends inwardly receiving the recess containing surface of said member for straddling the member thereat, said pawl shaft being supported for limited rotation and adapted to cooperate with said member recess to effect an interlocking latching relation of the hoisting mechanism;

c. bias means rotationally biasing said pawl shaft from a cocked relation toward said latching relation;

d. one of said pawl shaft or said member being vertically fixed in place and the other of said pawl shaft or said member being attached to the hoisting mechanism for vertical movement in conjunction with the raising and lowering of said hoist mechanism whereby said pawl shaft will effect said latching relation at a predetermined elevated position of said hoisting mechanism; and e. release means manually operable in opposition to said bias means to disengage said latching relation and enable lowering of said hoisting mechanism.

2. In an automotive hoist according to claim 1 in which said pawl shaft is vertically fixed and said member is relatively displaceable in conjunction with the raising and lowering of said hoisting mechanism.

3. In an automotive hoist according to claim 2 in which said pawl shaft slot is partially defined by a longitudinal surface and said latching relation is effected by a downward interference between the relatively upper edge of said slot surface and a shoulder of said recess.

4. In an automotive hoist according to claim 3 in which said release means is operative to rotate said pawl shaft until its relative upper slot edge is displaced from the downward interference of said latching relation.

5. In an automotive hoist according to claim 4 in which said vertical member comprises a gear rack operable in association with the vertical movement of said hoisting mechanism.

6. In an automotive hoist according to claim 5 in which said release means comprises a bi-stable mechanism.

7. In an automotive hoist according to claim 4 in which said release means is responsive to descending movement of said hoist mechanism to restore the cocking relation of said latch means.

8. In an automotive hoist according to claim 4 including retaining means operative in conjunction with said release means to retain the disengaged relation between said latch means and said hoisting mechanism until at least after the hoisting mechanism has descended to an elevated position below said predetermined elevated position at which said latching relation will occur.

9. In an automotive hoist according to claim 8 in which said pawl shaft includes a cam receiving surface, said retaining means includes a rotatable cam and biasing means urging said cam toward a retaining engagement with said cam receiving surface and said release means is operative when rotating said pawl shaft to place said cam receiving surface in position to receive said cam for effecting said retaining engagement.

10. In an automotive hoist according to claim 9 in which said cam receiving surface comprises a second slot formed in said pawl shaft, said cam is rotatable about an axis extending generally transverse to the rotational axis of said pawl shaft and said cam includes a radially outward lobe rotatable to a position received in said second slot to effect said retaining engagement.

11. In an automotive hoist according to claim 10 including actuating means to release said retaining engagement when the hoisting mechanism has descended to an elevated position below said predetermined elevated position at which said latching relation will occur.

12. In an automotive hoist according to claim 11 in which said actuating means comprises means descendable with said hoisting mechanism and operable to rotate said cam lobe away from said second slot for releasing said retaining engagement.

* * * * *